US006725813B1

(12) United States Patent
Boyer

(10) Patent No.: US 6,725,813 B1
(45) Date of Patent: Apr. 27, 2004

(54) TEMPERATURE-CONTROLLED VARIABLE SPEED WATER PUMP

(75) Inventor: Rick L. Boyer, Marshall, MI (US)

(73) Assignee: BorgWarner, Inc., Auburn Hills, MI (US)

( * ) Notice: Subject to any disclaimer, the term of this patent is extended or adjusted under 35 U.S.C. 154(b) by 0 days.

(21) Appl. No.: 10/378,120

(22) Filed: Mar. 3, 2003

(51) Int. Cl.[7] ..... F01P 5/10
(52) U.S. Cl. ..... 123/41.44; 123/41.47
(58) Field of Search ..... 123/41.44, 41.47

(56) References Cited

FOREIGN PATENT DOCUMENTS

JP 2000282862 A * 10/2000 ..... F01P/7/16

* cited by examiner

*Primary Examiner*—Noah P. Kamen
(74) *Attorney, Agent, or Firm*—Artz & Artz, P.C.; Greg Dziegielewski

(57) ABSTRACT

A controllable viscous clutch that is integral to a water pump. The pump impeller is part of the output member of the clutch while the input is composed of a central drive shaft (attached to a pulley) and a clutch plate. A bimetallic control element located internally within the output member of a viscous type water pump to control the flow rate of engine coolent to an engine. The bimetallic control element reacts directly to sensed engine coolant temperature to control the amount of viscous fluid entering or exiting an operating chamber of the viscous type water pump. This enables the water pump to deliver low coolant flow during cold engine conditions and higher flow once the engine exceeds a predetermined temperature. This provides faster engine warm-up resulting in improved occupant comfort, fuel economy, and decreased tailpipe emissions.

28 Claims, 4 Drawing Sheets

TEMPERATURE-CONTROLLED VARIABLE SPEED WATER PUMP

TECHNICAL FIELD

The invention relates generally to water pumps and more specifically to a temperature controlled variable speed water pump.

BACKGROUND ART

Today, most automobiles have an engine driven water pump wherein the flow characteristic of the pump is directly proportional to the speed of a water pump pulley which is typically driven at a ratio to the engine crank pulley via a belt. The ratio of the drive pulley, pump speed range, engine heat output, and radiator efficiency are among the numerous factors that contribute to the overall design of the water pump.

One approach currently used to provide more precise control of cooling capabilities of fan drives is to utilize a viscous fan clutch to drive the fan. Typically, these viscous fan clutches use a bimetallic control member in combination with a valve arm to control the amount of fluid entering the working chamber through the fill hole to the clutch working chamber. The bimetallic control member is typically affixed to the outside of the output member and reacts to underhood air temperature (indirect of engine temperature) to either open or close the fill hole.

A similar approach may be extremely beneficial for use in controlling a water pump. It is thus highly desirable to provide a water pump having a bimetallic controlled viscous clutch integral to the pump impeller. This solution is desirable to decrease the complexity of the overall design compared to an electrically controlled or fully electric water pump.

SUMMARY OF THE INVENTION

The above objects are accomplished by introducing a controllable viscous clutch that is integral to a water pump. The pump impeller is part of the output member of the clutch while the input is composed of a central drive shaft (attached to a pulley) and a clutch plate. As with a viscous fan clutch, the output member consists of two halves, a cover and a body. These components are made of a thermally conductive material constructed to provide sufficient heat transfer for the slipping clutch.

The viscous clutch is controlled similar to a viscous fan drive having a bimetallic control element wherein the viscous fluid flows from a reservoir chamber through a fill hole and into the working chamber defined between the output member and input member, where torque is transferred from the input to the output through fluid shear forces created within the working chamber. The fluid is returned to the reservoir by way of a differential speed (scavenge) pump.

The present invention locates this bimetallic control element internally within the output member of the device that, because of the location of the clutch, is a function only of the engine coolant temperature and not ambient air temperature.

The present invention delivers low coolant flow during cold engine conditions and higher, speed-limited flow once the engine exceeds a predetermined temperature. This will allow for faster engine warm-up resulting in improved occupant comfort, decreased tailpipe emissions, increased fuel economy, added safety due to faster defroster warm up, and increased water pump and cooling system life due to eliminating pump cavitation.

Other features, benefits and advantages of the present invention will become apparent from the following description of the invention, when viewed in accordance with the attached drawings and appended claims.

BEST MODE(s) FOR CARRYING OUT THE INVENTION

Figure 1:
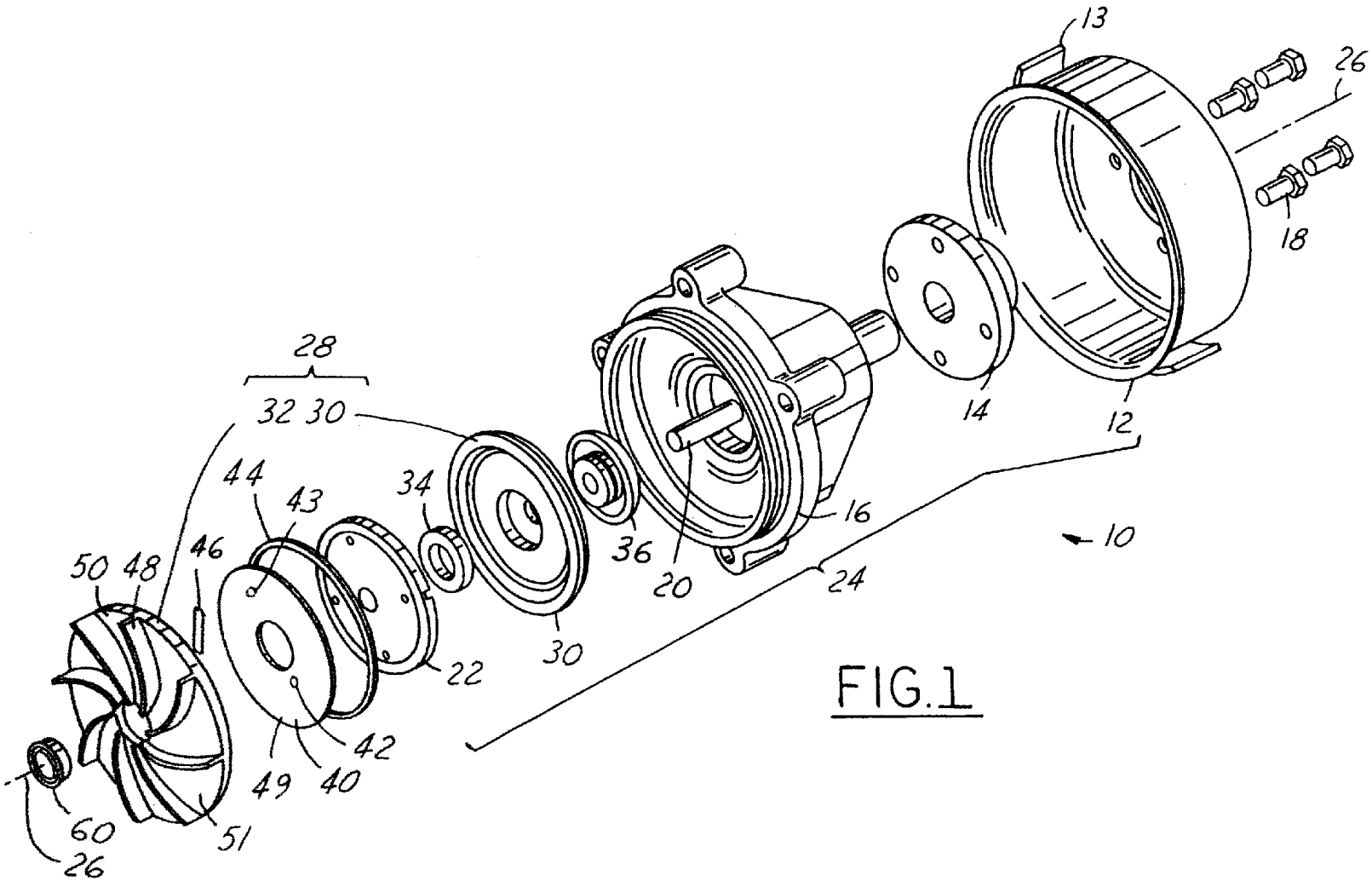
FIG. 1 is an exploded view of a variable speed water pump according to a preferred embodiment of the present invention.
Figure 2:
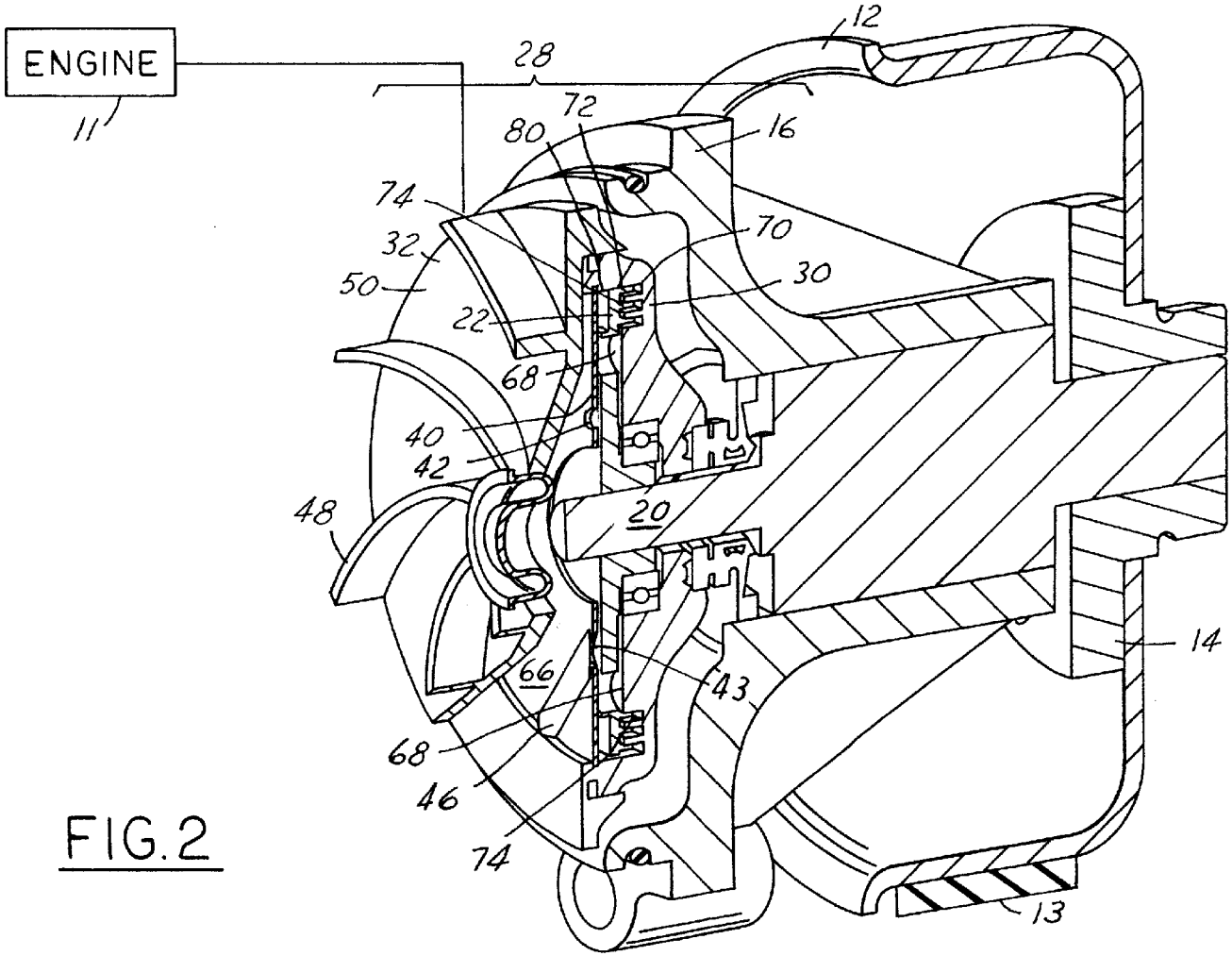
FIG. 2 is a section view of the assembled water pump of FIG. 1.

FIGS. 1 and 2 show an exploded and section view of a variable speed water pump 10 made in accordance with one preferred embodiment of the present invention. The pump 10 has a pulley 12 that is typically connected to the crankshaft of an internal combustion engine via a belt 13. The pulley 12 is coupled to a hub 14 and a water pump housing 16 using a plurality of bolts 18. The housing 16 has a water pump shaft 20 that is coupled to a clutch plate 22. The pulley 12, hub 14, water pump housing 16, water pump shaft 20, and clutch plate 22 collectively form an input member 24. The input member 24 rotates around a central axis 26 defined along the length of the water pump shaft 20 as a function of rotational speed of the belt 13 coupled to the internal combustion engine (not shown).

The clutch plate 22 is contained within an output member 28 that includes a body 30 and an impeller cover 32. The impeller cover 32 has a plurality of impeller blades 48 coupled about its outer surface 50. The impeller blades 48 are contained within a coolant chamber 51. The body 30 is mounted around the water pump shaft 20 using bearing 34. A rotary seal 36 coupled around the water pump shaft 20 between the body 30 and water pump housing 16. A reservoir plate 40 having a fill hole 42 and a scavenge hole 43 is also shown coupled around the water pump shaft 20. A gasket 44 seals the cover 32 to the body 30. A bimetallic control element 46 is coupled to the reservoir side 49 of the reservoir plate 40 to cover or uncover the scavenge hole 43. A plug 60 seals the assembly access hole in the impeller cover 32.

A fluid reservoir 66 containing a quantity of viscous fluid (not shown) is also shown as is defined between the impeller cover 32 and reservoir plate 40 that contains the bimetallic control element 46. The viscous fluid may enter an operating chamber 68 defined between the reservoir plate 40 and body 30 through fill hole 42 when the bimetallic control element 46 is positioned to cover the scavenge hole 43. The operating chamber 68 is fluidically coupled to a working chamber 74. The body 30 and clutch plate 22 each have a series of lands 70 and grooves 72 that define a working chamber 74. The viscous fluid is pumped back to the fluid reservoir 40 through scavenge hole 43.

During engine operation, the rotational action of the pulley 12 causes viscous fluid contained within the working chamber 74 to shear at a rate proportional to the speed of rotation of the pulley 12. The shear produces torque that is transmitted to the body 30. The rotation of the body 30 causes rotation of the cover 32, which causes rotation of the impeller blades 48 attached to the cover 32. This causes the movement of coolant within the coolant chamber 51 of the cooling system that is used to cool the engine.

By varying the amount of viscous fluid within the working chamber 74, the amount of torque transmittal will vary and thus will change the rotational speed of the impeller blades 48 used to cool the engine. The amount of viscous fluid entering the operating chamber 68, and hence the working chamber 74, is controlled by the bimetallic control element 46, which covers and uncovers the scavenge hole 43 between the fluid reservoir 66 and operating chamber 68, depending upon the sensed engine coolant temperature. The bimetallic control element 46 is calibrated with set temperature points for covering or uncovering the scavenge hole 43 prior to the placement of the water pump 10 within the vehicle cooling system.

The bimetallic control element 46 senses engine coolant temperature through conduction of the temperature from the engine coolant through the impeller cover 32. As engine coolant temperature increases, which indicates an increase in engine temperature, the bimetallic control element 46 moves to a position covering the scavenge hole 43, thereby stopping fluid flow from the operating chamber 68 to the fluid reservoir 66. This increases the amount of viscous fluid in the working chamber 74 due to flow rate through the fill hole 42, thereby generating more torque to drive the output member 28, and hence the impeller blades 48 coupled to the cover 32. The rotation of the impeller blades 48 pumps engine coolant to the engine as a function of impeller blade 48 rotational speed.

Below a calibrated engine coolant temperature, the bimetallic control element 46 moves to uncover the scavenge hole 43, thereby allowing the flow of viscous fluid from the operating chamber 68 to the fluid reservoir 66. This decreases the amount of viscous fluid, and hence the shear created within the working chamber 74. This decreases the amount of torque generated to rotate the output member 28. This in turn decreases the pumping rate of engine coolant to the engine.

Figure 3:
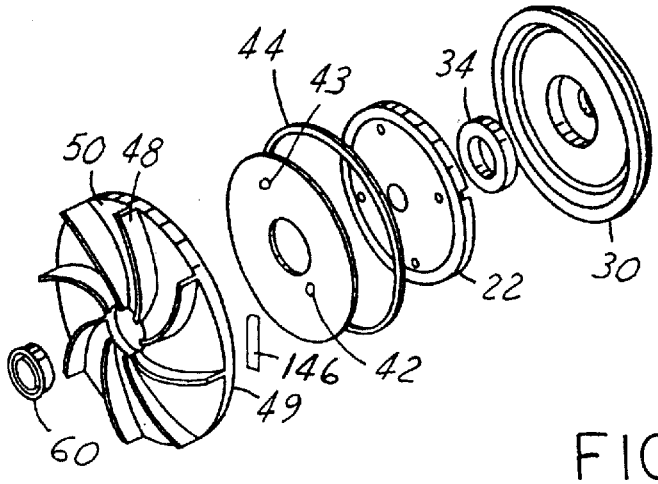
FIG. 3 is a exploded view of a variable speed water pump according to another preferred embodiment of the present invention.
Figure 4:
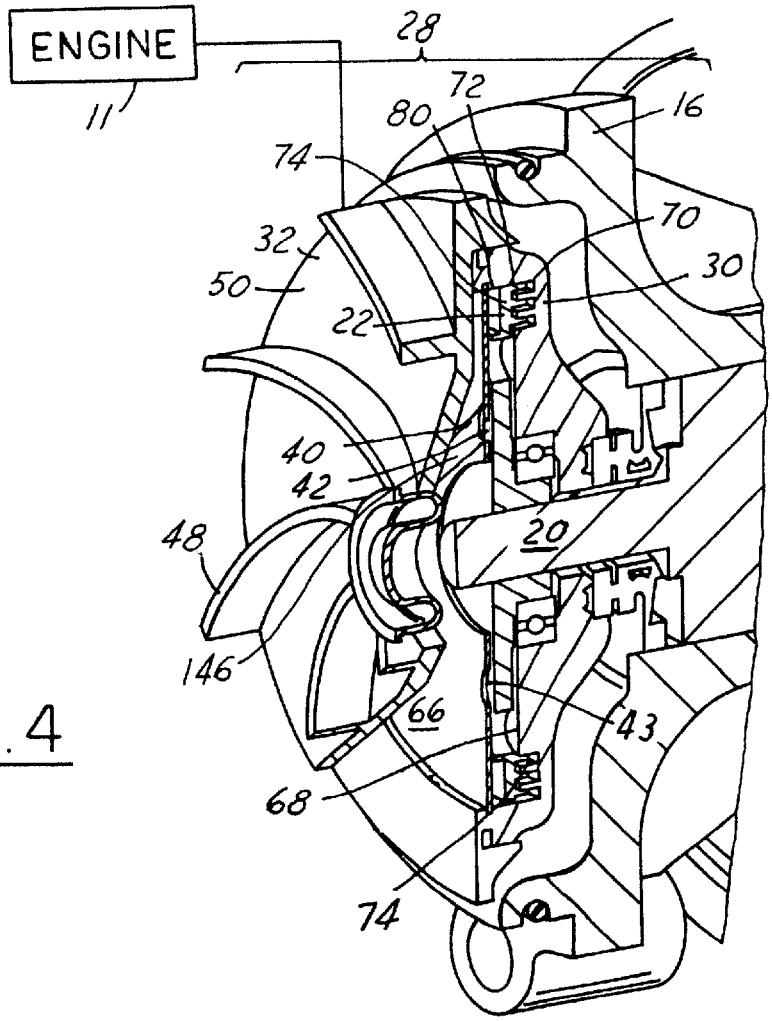
FIG. 4 is a section view of the assembled water pump of FIG. 1.

In an alternative preferred embodiment, as shown in FIGS. 3 and 4, the bimetal control element 146 is positioned to cover or uncover the fill hole 42 instead of the scavenge hole 43 as in FIGS. 1 and 2. The bimetallic control element 146 senses engine coolant temperature through conduction of the temperature from the engine coolant through the impeller cover 32. As engine coolant temperature increases, which indicates an increase in engine temperature, the bimetallic control element 146 moves to a position uncovering the fill hole 42, thereby allowing fluid flow from the fluid reservoir 66 to the operating chamber 68 and to the working chamber 74. This increases the amount of viscous fluid in the working chamber 74 due to flow rate through the fill hole 42, thereby generating more torque to drive the output member 28, and hence the impeller blades 48 coupled to the cover 32. The rotation of the impeller blades 48 pumps engine coolant to the engine as a function of impeller blade 48 rotational speed.

Below a calibrated engine coolant temperature, the bimetallic control element 146 moves to cover the fill hole 42, thereby preventing the flow of viscous fluid from the fluid reservoir 66 to the operating chamber 68 while allowing fluid flow from the working chamber 74 to the fluid reservoir 66 through the scavenge hole 43. This decreases the amount of viscous fluid, and hence the shear created within the working chamber 74. This decreases the amount of torque generated to rotate the output member 28. This in turn decreases the pumping rate of engine coolant to the engine.

Figure 5:
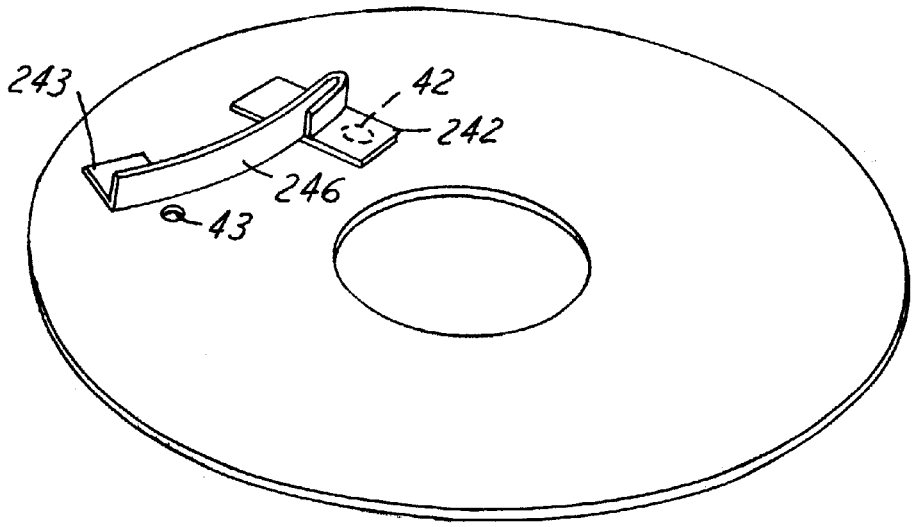
FIG. 5 exploded view of a portion of a variable speed water pump according to another preferred embodiment of the present invention.

In another alternative preferred embodiment, as shown in FIG. 5, a one piece dual-functional bimetallic control element 246 is formed having a first portion 243 capable of covering and uncovering the scavenge hole 43 and a second portion 242 capable of covering and uncovering the fill hole 42. The control element 246 simply pivots to uncover the scavenge hole 43 and cover the fill hole 42 in one position and cover the scavenge hole 43 and uncover the fill hole 42 in another position.

The bimetallic control element 246 senses engine coolant temperature through conduction of the temperature from the engine coolant through the impeller cover 32. As engine coolant temperature increases, which indicates an increase in engine temperature, the first portion 243 bimetallic control element 246 moves to a position covering the scavenge hole 43, thereby stopping fluid flow from the operating chamber 68 to the fluid reservoir 66. At the same time, the second portion 242 of the bimetallic element 246 moves to a position to uncover the fill hole 42, thereby allowing viscous fluid to flow from the fluid reservoir 66 to the operating chamber 68. This increases the amount of viscous fluid in the working chamber 74 due to flow rate through the fill hole 42, thereby generating more torque to drive the output member 28, and hence the impeller blades 48 coupled to the cover 32. The rotation of the impeller blades 48 pumps engine coolant to the engine as a function of impeller blade 48 rotational speed.

Below a calibrated engine coolant temperature, the first portion 243 of the bimetallic control element 246 moves to uncover the scavenge hole 43, thereby allowing the flow of viscous fluid from the operating chamber 68 to the fluid reservoir 66. At the same time, the second portion 242 of the bimetallic element 246 moves to cover the fill hole 42. This decreases the amount of viscous fluid, and hence the shear created within the working chamber 74. This decreases the amount of torque generated to rotate the output member 28. This in turn decreases the pumping rate of engine coolant to the engine.

Figure 6:
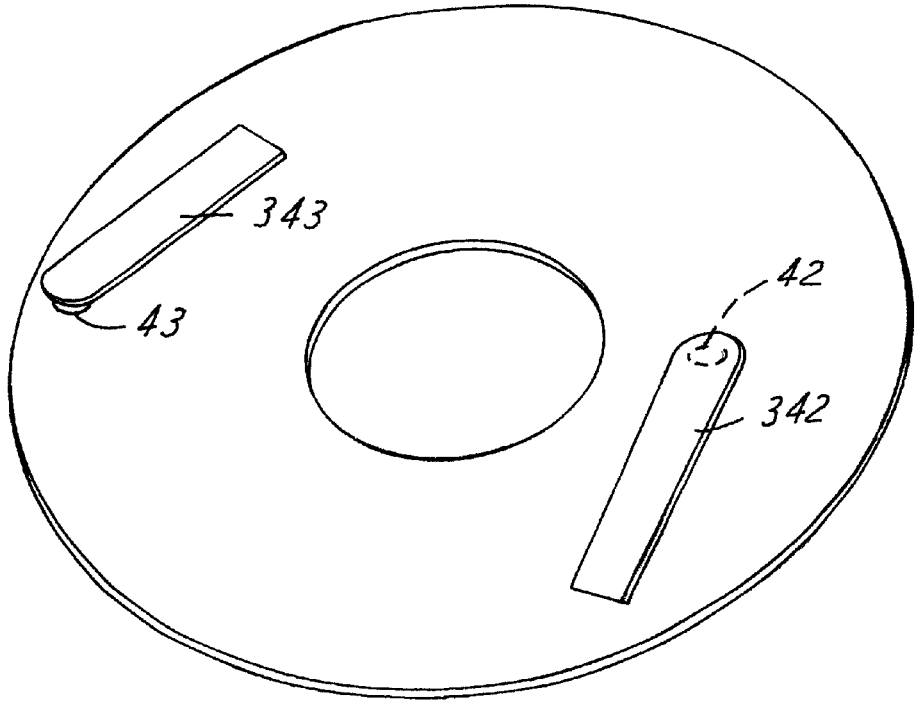
FIG. 6 is a perspective view of a portion of a variable speed water pump according to another preferred embodiment of the present invention.

Of course, in another preferred embodiment, as shown in FIG. 6, a pair of bimetallic control elements 343, 342 could be used in place of the one piece dual functional bimetallic element 246 as described above in FIG. 5. A first bimetallic element 343 moves to cover or uncover the scavenge hole 43, while a second bimetallic element 342 covers or uncovers the fill hole 42. The method for covering or uncovering the scavenge hole 43 and fill hole 42 works in exactly the same manner as in the dual control bimetallic element 246 of FIGS. 4 and 5, in which the first bimetallic element 343 covers the scavenge hole 43 while the second bimetallic element 342 uncovers the fill hole 42 above a calibrated engine coolant temperature and in which the first bimetallic element 343 uncovers the scavenge hole 43 while the second bimetallic element 342 covers the fill hole 42 below a calibrated engine coolant temperature.

The use of a viscous type water pump 10 in general within the output member 28 of a viscous type water pump 10 offers many advantages. First, the controllable viscous type water pump minimizes water pump cavitation at high engine speeds, particularly during operating conditions at high coolant temperatures. The flow-limiting feature of engine coolant in the coolant chamber of viscous type water pumps can also minimize collapsing potential of weakened coolant hoses during sudden engine accelerations. The flow-limiting feature of engine coolant in the coolant chamber also enables a higher pulley ratio; resulting in improved heat transfer from the cooling system at lower engine speeds, including particularly engine idle conditions. The higher pulley ratio described above also provides input to a viscous fan drive (not shown), the result of which further improves cooling system performance and air conditioning performance, particularly at engine idle conditions. The flow-limiting feature also aids in minimizing flow-induced static charge buildup in coolant hoses that may improve coolant hose durability. Also, the flow-limiting feature may result in improved water pump life due to reduced differential rotational speeds at the contacting seal surfaces.

The introduction of the bimetallic element 46, 146, 246 to the viscous type water pumps 10 as described in FIGS. 1–5 delivers low coolant flow during cold engine conditions and higher, speed-limited flow once the engine 11 exceeds a predetermined temperature. This will allow for faster engine warm-up resulting in improved occupant comfort, decreased tailpipe emissions, increased fuel economy, added safety due to faster defroster warm up, and increased water pump and cooling system life due to eliminating pump cavitation.

While the best modes for carrying out the present invention have been described in detail herein, those familiar with the art to which this invention relates will recognize various alternate designs and embodiments for practicing the invention as defined by the following claims. All of these embodiments and variations that come within the scope and meaning of the present claims are included within the scope of the present invention.

What is claimed is:

1. A viscous type water pump used to control the flow rate of engine coolant within a coolant chamber coupled to an internal combustion engine, the water pump comprising:

an input member including a clutch plate coupled to a water pump shaft;

a belt operatively coupled to the internal combustion engine and said input member, said belt capable of causing the rotation of said input member around a central axis, said central axis defined along the length of said water pump shaft;

an output member rotatably coupled to said water pump shaft, said output member including a body and an impeller cover having a plurality of impeller blades contained within the coolant chamber, wherein said clutch plate is located within said body and said impeller cover;

a working chamber defined between said output member and said clutch plate;

an operating chamber fluidically coupled to said working chamber and defined between said output member and said clutch plate;

a reservoir plate rotatably coupled to said water pump shaft between said clutch plate and said impeller cover, said reservoir plate having a fill hole and a scavenge hole, said reservoir plate and said impeller cover defining a fluid reservoir;

a viscous fluid contained within said fluid reservoir; and a bimetallic control element positioned in said fluid reservoir and coupled to said reservoir plate, said bimetallic control element capable of sensing engine coolant temperature through said impeller cover, and capable of movement between a first position and a second position as a function of said sensed engine coolant temperature to control the flow rate of said viscous fluid from said working chamber to said fluid reservoir.

2. The water pump of claim 1, wherein said first position is defined wherein said bimetallic control element is positioned such that said viscous fluid can flow from said working chamber through said scavenge hole and into said fluid reservoir.

3. The water pump of claim 1, wherein said second position is defined wherein said bimetallic control element covers said scavenge hole in said reservoir plate to substantially prevent the flow of said viscous fluid from said working chamber to said fluid reservoir.

4. The water pump of claim 1 further comprising a second bimetallic element positioned in said fluid reservoir and coupled to said reservoir plate, said bimetallic control element capable of sensing engine coolant temperature through said impeller cover, and capable of movement between a third position and a fourth position as a function of said sensed engine coolant temperature to control the flow rate of said viscous fluid from said fluid reservoir to said operating chamber.

5. The water pump of claim 4, wherein said first position is defined wherein said bimetallic control element is positioned such that said viscous fluid can flow from said working chamber through said scavenge hole and into said fluid reservoir and wherein said third position is defined wherein said second bimetallic element is positioned such that said viscous fluid cannot flow from said fluid chamber through said scavenge hole and into said operating chamber.

6. The water pump of claim 4, wherein said second position is defined wherein said bimetallic control element is positioned such that said viscous fluid cannot flow from said working chamber through said scavenge hole and into said fluid reservoir and wherein said fourth position is defined wherein said second bimetallic element is positioned such that said viscous fluid can flow from said fluid chamber through said scavenge hole and into said operating chamber.

7. The water pump of claim 4, wherein said bimetallic element and said second bimetallic element are integrally formed and comprise a single dual functional bimetallic element.

8. A method for precisely controlling the flow rate of engine coolant within a coolant chamber of a cooling system used to control the temperature of an internal combustion engine at a given engine speed, the method comprising:

(a) operatively coupling a viscous type water pump within the cooling system, the viscous coupling comprising:

an input member including a clutch plate coupled to a water pump shaft;

a belt operatively coupled to the internal combustion engine and said input member, said belt capable of causing the rotation of said input member around a central axis, said central axis defined along the length of said water pump shaft;

an output member rotatably coupled to said water pump shaft, said output member including a body and an impeller cover having a plurality of impeller blades contained within the coolant chamber, wherein said clutch plate is located within said body and said impeller cover;

a working chamber defined between said output member and said clutch plate;

an operating chamber fluidically coupled to said working chamber and defined between said output member and said clutch plate;

a reservoir plate rotatably coupled to said water pump shaft between said clutch plate and said impeller cover, said reservoir plate having a fill hole and a scavenge hole, said reservoir plate and said impeller cover defining a fluid reservoir;

a viscous fluid contained within said fluid reservoir;

a bimetallic control element positioned in said fluid reservoir and coupled to said reservoir plate;

(b) sensing an engine coolant temperature using said bimetallic control element; and (c) controlling the amount of said viscous fluid contained within said working chamber as a function of said sensed engine coolant temperature at a given engine speed, wherein the amount of viscous fluid contained in said working chamber controls the amount of slippage created at a given engine speed between said input member and said output member to drive said output member.

9. The method of claim 8, wherein (c) controlling the amount of said viscous fluid contained within said working chamber comprises: (c) controlling the relative positioning of said bimetallic control element between a first position and a second position as a function of said sensed engine coolant temperature, wherein said first position maximizes the accumulation of said viscous fluid within said operating chamber and wherein said second position minimizes the accumulation of said viscous fluid within said working chamber.

10. The method of claim 9, wherein said bimetallic control element is in said first position when the temperature of said engine coolant as sensed by said bimetallic control element is less than a predetermined engine coolant temperature.

11. The method of claim 10, wherein said bimetallic control element uncovers said scavenge hole in said first position.

12. The method of claim 10, wherein said bimetallic control element covers said fill hole in said first position.

13. The method of claim 10, wherein said bimetallic control element uncovers said scavenge hole and covers said fill hole in said first position.

14. The method of claim 9, wherein the viscous clutch further comprises a second bimetallic element positioned in said fluid reservoir and coupled to said reservoir plate.

15. The method of claim 14, wherein (c) controlling the amount of said viscous fluid contained within said working chamber comprises: (c) controlling the relative positioning of said bimetallic element between a first position and a second position, said first position defined such that said bimetallic element uncovers said scavenge hole and wherein said second position defined such that said bimetallic element covers said scavenge hole; and controlling the relative positioning of said second bimetallic element between a third position and a fourth position, wherein said third position is defined such that said second bimetallic element is covering said fill hole and wherein said fourth position is defined such that said second bimetallic element is uncovering said fill hole.

16. The method of claim 15, wherein said bimetallic element is positioned in said first position and said second bimetallic element is positioned in said third position when the temperature of said engine coolant as sensed by said is less than a predetermined engine coolant temperature.

17. The method of claim 15, wherein said bimetallic element is positioned in said second position when said second bimetallic element is positioned in said fourth position when the temperature of said engine coolant as sensed by said is greater than a predetermined engine coolant temperature.

18. The method of claim 9, wherein said bimetallic control element is in said second position when the temperature of said engine coolant as sensed by said is greater than a predetermined engine coolant temperature.

19. The method of claim 18, wherein said bimetallic control element covers said scavenge hole in said second position.

20. The method of claim 18, wherein said bimetallic control element uncovers said fill hole in said second position.

21. The method of claim 18, wherein said bimetallic control element covers said scavenge hole and uncovers said fill hole in said second position.

22. The method of claim 8, wherein (b) sensing an engine coolant temperature using said bimetallic control element comprising sensing engine coolant temperature by way of conduction through said impeller cover.

23. A viscous type water pump used to control the flow rate of engine coolant within a coolant chamber coupled to an internal combustion engine, the water pump comprising:

an input member including a clutch plate coupled to a water pump shaft;

a belt operatively coupled to the internal combustion engine and said input member, said belt capable of causing the rotation of said input member around a central axis, said central axis defined along the length of said water pump shaft;

an output member rotatably coupled to said water pump shaft, said output member including a body and an impeller cover having a plurality of impeller blades contained within the coolant chamber, wherein said clutch plate is located within said body and said impeller cover;

a working chamber defined between said output member and said clutch plate;

an operating chamber fluidically coupled to said working chamber and defined between said output member and said clutch plate;

a reservoir plate rotatably coupled to said water pump shaft between said clutch plate and said impeller cover, said reservoir plate having a fill hole and a scavenge hole, said reservoir plate and said impeller cover defining a fluid reservoir;

a viscous fluid contained within said fluid reservoir; and a bimetallic control element positioned in said fluid reservoir and coupled to said reservoir plate, said bimetallic control element capable of sensing engine coolant temperature through said impeller cover, and capable of movement between an first position to a second position as a function of said sensed engine coolant temperature to control the flow of viscous fluid from said fluid reservoir through said fill hole and into said operating chamber.

24. The water pump of claim 23, wherein said first position is defined wherein said bimetallic control element is positioned such that said viscous fluid can flow from said fluid reservoir through said fill hole and into said operating chamber.

25. The water pump of claim 23, wherein said second position is defined wherein said bimetallic control element covers said fill hole in said reservoir plate to substantially prevent the flow of said viscous fluid from said fluid reservoir to said operating chamber.

26. A viscous type water pump used to control the flow rate of engine coolant within a coolant chamber coupled to an internal combustion engine, the water pump comprising:

an input member including a clutch plate coupled to a water pump shaft;

a belt operatively coupled to the internal combustion engine and said input member, said belt capable of causing the rotation of said input member around a central axis, said central axis defined along the length of said water pump shaft;

an output member rotatably coupled to said water pump shaft, said output member including a body and an impeller cover having a plurality of impeller blades contained within the coolant chamber, wherein said clutch plate is located within said body and said impeller cover;

a working chamber defined between said output member and said clutch plate;

an operating chamber fluidically coupled to said working chamber and defined between said output member and said clutch plate;

a reservoir plate rotatably coupled to said water pump shaft between said clutch plate and said impeller cover, said reservoir plate having a fill hole and a scavenge hole, said reservoir plate and said impeller cover defining a fluid reservoir;

a viscous fluid contained within said fluid reservoir; and a bimetallic control element positioned in said fluid reservoir and coupled to said reservoir plate, said bimetallic control element capable of sensing engine coolant temperature through said impeller cover, and capable of movement between an first position to a second position as a function of said sensed engine coolant temperature to control the flow rate of said viscous fluid from said fluid reservoir to said operating chamber and to control the flow rate of fluid from said working chamber to said fluid reservoir.

27. The water pump of claim 26, wherein said first position is defined wherein a first portion of said bimetallic control element is positioned such that said viscous fluid can flow from said working chamber through said scavenge hole and into said fluid reservoir and wherein a second portion of said bimetallic control element covers said fill hole in said reservoir plate to substantially prevent the flow of said viscous fluid from said fluid reservoir to said operating chamber.

28. The water pump of claim 26, wherein said second position is defined wherein said bimetallic control element covers said scavenge hole in said reservoir plate to substantially prevent the flow of said viscous fluid from said working chamber to said fluid reservoir and wherein a second portion of said bimetallic control element is positioned such that said viscous fluid can flow from said fluid reservoir through said fill hole and into said operating chamber.

* * * * *